US007959488B2

(12) United States Patent
Talamo

(10) Patent No.: US 7,959,488 B2
(45) Date of Patent: Jun. 14, 2011

(54) BRASSIERE PAD SYSTEM

(76) Inventor: Tania Alessandra Talamo, Flushing, NY (US)

( * ) Notice: Subject to any disclaimer, the term of this patent is extended or adjusted under 35 U.S.C. 154(b) by 825 days.

(21) Appl. No.: 11/974,558

(22) Filed: Oct. 15, 2007

(65) Prior Publication Data

US 2009/0098802 A1 Apr. 16, 2009

(51) Int. Cl.
*A41C 3/00* (2006.01)

(52) U.S. Cl. ..... 450/57; 450/54; 2/268

(58) Field of Classification Search ..... 450/36–38, 450/54–58; 2/267, 268; 623/7, 8
See application file for complete search history.

(56) References Cited

U.S. PATENT DOCUMENTS

| | | | | | |
|---|---|---|---|---|---|
| 5,050,595 | A | | 9/1991 | Krafft | |
| 5,643,043 | A | | 7/1997 | Pflum | |
| 5,720,046 | A | * | 2/1998 | Lopez et al. | 2/159 |
| 5,782,671 | A | * | 7/1998 | Suen et al. | 450/38 |
| 5,840,327 | A | | 11/1998 | Gale et al. | |
| 5,950,239 | A | * | 9/1999 | Lopez | 2/115 |
| 5,964,641 | A | | 10/1999 | Laughridge | |
| 5,989,101 | A | * | 11/1999 | Jenn-Shyang et al. | 450/57 |
| 5,997,380 | A | * | 12/1999 | Yang | 450/57 |
| 6,089,953 | A | * | 7/2000 | Chen | 450/1 |
| 6,132,288 | A | | 10/2000 | Aerts | |
| 6,231,423 | B1 | * | 5/2001 | Deal et al. | 450/57 |
| 6,241,575 | B1 | | 6/2001 | Shailer | |
| 6,258,020 | B1 | * | 7/2001 | Lopez | 600/15 |
| 6,283,820 | B1 | * | 9/2001 | Huang | 450/57 |
| 6,296,545 | B1 | * | 10/2001 | Chen | 450/38 |
| 6,332,862 | B1 | * | 12/2001 | Zandman | 600/15 |
| 6,464,717 | B1 | | 10/2002 | Smith et al. | |
| 6,755,717 | B2 | | 6/2004 | Smith | |
| 6,811,463 | B2 | | 11/2004 | Martz | |
| 6,921,316 | B1 | | 7/2005 | Jian | |
| 6,997,775 | B2 | | 2/2006 | Jagaric et al. | |
| 7,052,360 | B2 | | 5/2006 | Lau | |
| 2003/0105445 | A1 | | 6/2003 | Lange et al. | |

* cited by examiner

*Primary Examiner* — Gloria Hale
(74) *Attorney, Agent, or Firm* — Tutunjian & Bitetto, PC; Susan Paik

(57) ABSTRACT

A brassiere pad assembly is provided for use in a brassiere for delivering optimal support, aesthetic enhancement and health benefits including a first panel comprised of a flexible material having a plurality of perforations and a bottom edge. A second panel is provided having an interior surface and an exterior surface, the second panel having at least a bottom edge affixed to at least the bottom edge of the first panel. A third panel is provided comprising a membrane defining a cavity having at least one attachment means formed therein, the third panel being placed between the first and second panels and having at least a bottom edge affixed to the second panel. An insertable element may be provided configured to be receivable and securable within the cavity of the third panel for imparting skin therapeutic benefits to a wearer.

25 Claims, 6 Drawing Sheets

BRASSIERE PAD SYSTEM

A portion of the disclosure of this patent document contains material, which is subject to copyright protection. The copyright owner has no objection to the facsimile reproduction by anyone of this patent document or the patent disclosure as it appears in the U.S. Patent and Trademark Office patent file or records, but otherwise reserves all copyrights whatsoever.

BACKGROUND OF THE INVENTION

1. Technical Field of the Invention

The present invention generally relates to a comprehensive form-enhancing, supportive and therapeutic undergarment assembly, and, more particularly, to a brassiere pad assembly for providing natural-looking support and aesthetic shape enhancement to the human breast as well as promoting and providing well-being, health and cosmetic benefits and therapeutic effects to a wearer.

2. Description of Related Art

Many women are concerned with improving the appearance of and/or enhancing the size or shape of their breasts, as well as the overall health, well-being and condition of their bodies/skin. However, as surgical approaches to breast enhancement may be risky and carry the potential for serious complications, most women often prefer a more conservative approach to breast enhancement.

In the field of undergarments, numerous brassiere designs have been developed for providing support to human breasts as well as enhancing their appearance and/or size. There exists today a wide range of brassieres and bra pad inserts developed to accentuate the fullness of the breast, many of which involve the use of padding comprised of various materials such as foam, silicone and liquids, etc.

However, many such brassieres developed for form and/or size enhancement often impart an unnatural appearance to the breast. In addition, comfort to the wearer may be compromised, since such brassieres and bra pads are often bulky, lack breathability and/or fail to conform to the wearer in a manner which genuinely complements the natural shape and movement of the breast. Namely, typical fluid-filled (e.g., silicone) pads do not conform to and move naturally with the shape of the breast but merely sit underneath the breast and further, lack breathability.

For example, U.S. Pat. No. 5,997,380 to Yang (hereinafter Yang) teaches a brassiere having a liquid filled sac disposed in an interior of each cup. Note that such sac in Yang is comprised of two tough and water-impermeable plastic materials fused together; as such assembly is impervious to both water and air, it can often lead to or aggravate perspiration in the breast area and thus cause discomfort for the wearer, especially in warm weather.

It is often desirable to not only enhance the outward physical appearance of the human breast but to promote physiological benefits as well. For example, U.S. Patent Application No. 2003/0105445 discusses a breast pad having one face containing a skin benefit ingredient for replacing skin lipids to the breast and nipple skin. The delivery of such skin benefit ingredient however, simply involves a pad imparted with same placed adjacent to the breast. Such pad is also intended to have absorptive properties to absorb leakage from the breast and minimize soiling to clothing.

Accordingly, a need exists for a brassiere pad system for effectively supporting, enhancing and improving the overall appearance of the breast while optimizing wellness, skin condition and comfort for a wearer.

SUMMARY OF THE INVENTION

The present invention generally relates to brassiere pads, and, more particularly, to a bra pad system configured for incorporation into a brassiere for providing improved form, size and/or shape enhancement to the breasts while maximizing comfort and imparting beneficial physiological and therapeutic effects to a wearer.

Advantageously, a brassiere pad system according to an aspect of the present invention provides comprehensive beneficial effects including aesthetic effects such as supportive shape-enhancement, sensory benefits such as via touch and smell (e.g., massage, aromatherapy, etc.) and health benefits such as improvement of skin condition and air flow in the breast area, all in a manner which is non-constrictive, promotes a natural-looking appearance and does not compromise the wearer's comfort or mobility.

A brassiere pad system according to the present invention preferably comprises e.g., at least a three part assembly, wherein at least two of the three parts of the assembly have at least a three prong design. The parts of the assembly work together to provide a 'tripod' structural effect, pushing and distributing the weight of the breast towards the center and upwards for maximum lift and support, and ultimately aesthetic enhancement.

The present invention promotes well-being through the thoughtful construction of a bra pad system that does not constrict in an uncomfortable or potentially harmful way but rather delivers support and therapeutic benefits to the wearer. In addition, the present invention imparts sensory benefits through a system and method for delivering scent benefits, e.g., aromatherapy.

According to one aspect of the present invention, a brassiere pad assembly is provided comprising a first panel comprised of a flexible material having a plurality of perforations and a bottom edge. A second panel is provided having an interior surface and an exterior surface, the second panel having at least a bottom edge affixed to at least the bottom edge of the first panel. A third panel is provided comprising a membrane defining a cavity having at least one attachment means formed therein, the third panel being placed between the first and second panels and having at least a bottom edge affixed to the second panel.

According to another aspect, a brassiere pad assembly for a brassiere is provided comprising a first panel comprised of a flexible material having a plurality of perforations and a bottom edge. A second panel having an interior surface and an exterior surface is provided, the second panel having at least a bottom edge affixed to at least the bottom edge of the first panel and a plurality of magnets attached to the interior surface of the second panel. A third panel is provided comprising a membrane defining a cavity having at least one attachment means formed therein, the third panel being placed between the first and second panels and having at least a bottom edge affixed to the second panel.

According to yet another aspect, a brassiere pad assembly for a brassiere is provided comprising a first magnetic panel having an interior surface and an exterior surface, the panel having a plurality of magnets attached to the interior surface thereof. A second magnetic panel is provided affixed to the first magnetic panel, further comprising a plurality of magnets attached to an exterior surface of the second magnetic panel, wherein each of the magnets on the second magnetic panel is configured to face and be in substantial alignment with and repel each corresponding magnet of the first magnetic panel.

These and other aspects, features, and advantages of the present invention will be described or become apparent from the following detailed description of the preferred embodiments, which is to be read in connection with the accompanying drawings.

BRIEF DESCRIPTION OF THE DRAWINGS

In the drawings, wherein like reference numerals denote similar elements throughout the views.

It should be understood that the drawings are for purposes of illustrating the concepts of the invention and are not necessarily the only possible configurations for illustrating the invention.

DETAILED DESCRIPTION OF PREFERRED EMBODIMENTS

A brassiere pad assembly in accordance with an aspect of the present invention, advantageously boasts a unique configuration providing inimitable functionality. Namely, a distinctive bra pad system is provided for imparting wellness, cosmetic and aesthetic benefits to a wearer while affording optimal comfort and ease of use. A resultant brassiere pad according to an aspect of the present invention promotes comprehensive well-being of the wearer while simultaneously providing incomparable support, shape and aesthetic appeal.

Figure 1:
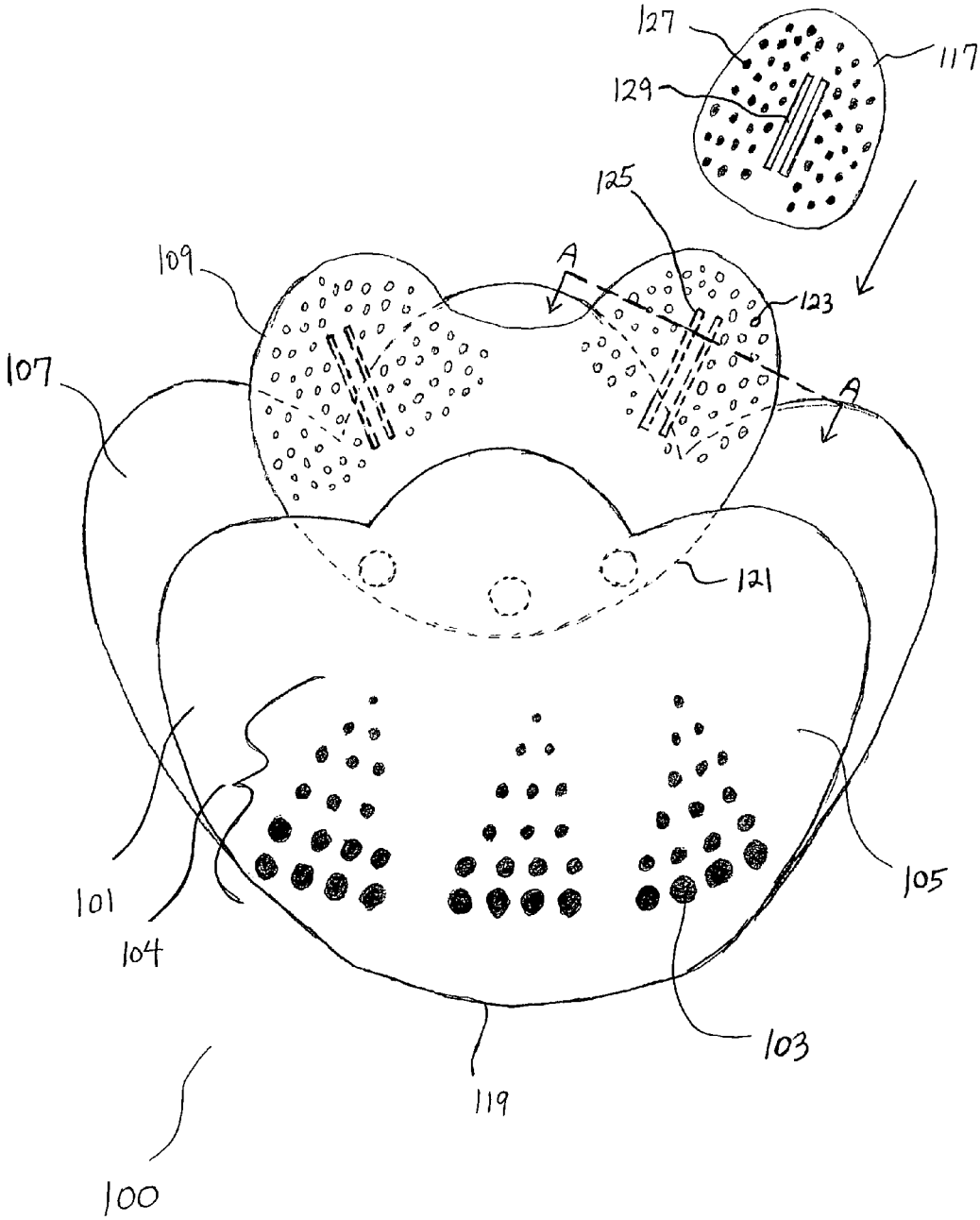
FIG. 1 is an exemplary front view of a brassiere pad assembly according to an aspect of the present invention.

An exemplary bra pad assembly 100 is illustrated in FIG. 1. Each brassiere pad 100 is preferably configured to be insertable in each bra cup of a brassiere (not shown) and may further be affixable within a bra cup via permanent or removable means (e.g., stitching, hook and loop fasteners, adhesives, etc.).

In one exemplary embodiment, a bra pad assembly according to an aspect of the present invention may comprise at least the following components: 1) a first panel 101, 2) a second panel 107 partially affixed to the first panel 101, 3) a third panel 109 partially attached to the second panel 107, and 4) an insert element or "tablet" 117 configured to be removably insertable within the third panel 109. At least the first and second panels 101, 107 are preferably shaped and sized to fit a human breast and may be provided in a range of sizes without departing from the scope or spirit of the present invention.

The first panel 101 is preferably comprised of a flexible, pliable and/or elastic material which includes a plurality of perforations or apertures (not shown) distributed throughout, e.g., in a mesh configuration or 'crochet' or 'filigree' pattern, to impart breathability, facilitate airflow, and conform to the shape of the breast, creating a more natural look. Exemplary dimensions of the apertures of the first panel 101 may comprise, e.g., about 3.0 mm to about 10.0 mm in width/diameter.

The material of panel 101 preferably includes insulating properties so as to, e.g., absorb and retain body heat and mold to the wearer's skin. Exemplary panel 101 materials may include, e.g., silicone, rubber, neoprene, gel-filled mesh, etc. In one exemplary embodiment, the first panel 101 may be provided in a 'tiara' or multi-pronged (e.g., a three headed) configuration. Exemplary dimensions of the first panel 101 may comprise about 3.5 inches to about 4.5 inches in width and about 3.0 inches to about 4.0 inches in height. A preferred dimension of panel 101 comprises about 4.0 inches in width and about 3.5 inches in height.

The first panel 101 may include a plurality of protrusions 103 affixed to an inside surface 105 thereof. The "inside surface" 105 is that which is placed in direct contact with the skin (of the breast) when the assembly 100 is worn by a user. The protrusions 103 may comprise raised elements of any shape, size or combination, e.g., having circular ends, conical ends, etc. and are preferably comprised of a soft, flexible material having at least flexible ends for creating a gentle massaging effect when contacted with the skin. In alternate embodiments, the protrusions 103 may comprise fluid, semi-solid, gel or air-filled membranes, sacs or vesicles. Any number of protrusions 103 comprised of any material in any pattern, shape or configuration may be provided and may be fixedly attached and/or integrally formed with the panel 101.

Figure 2:
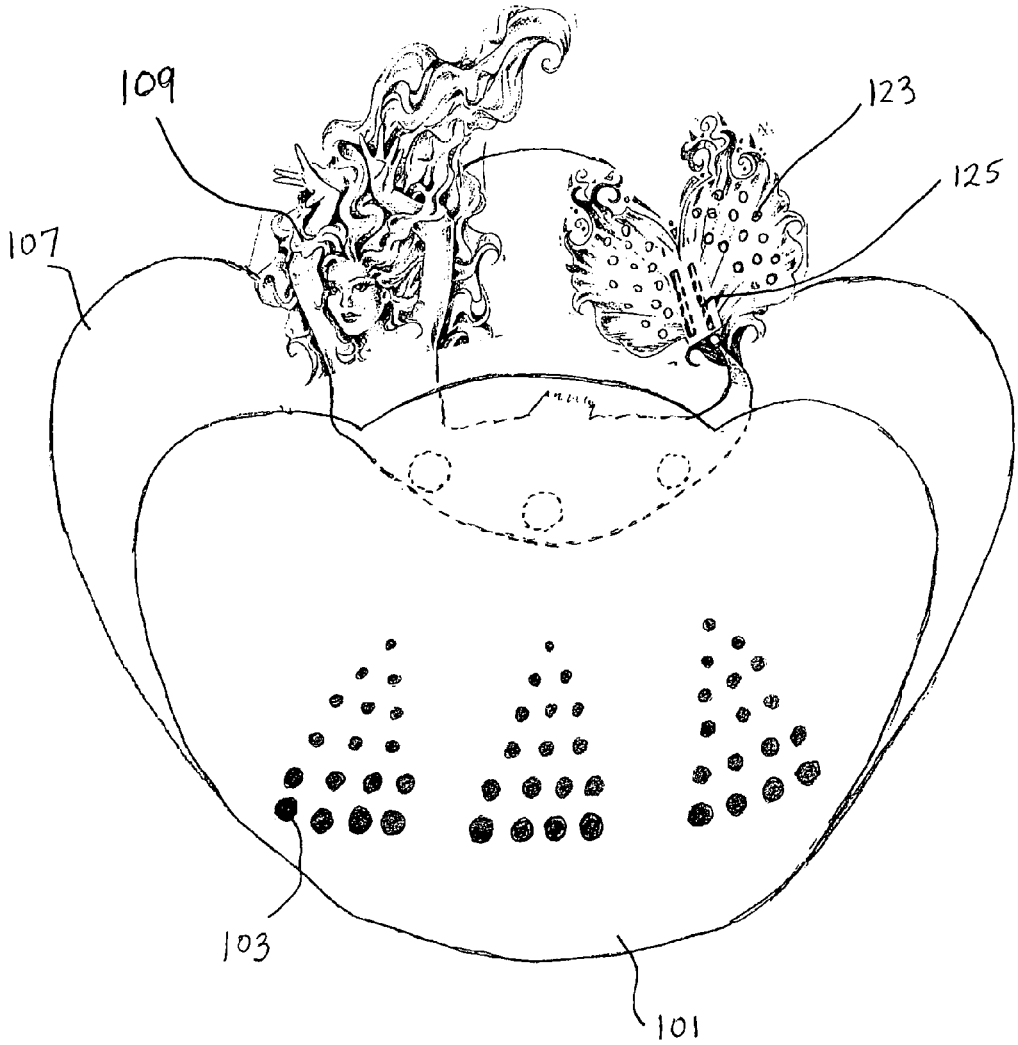
FIG. 2 is an exemplary front view of a brassiere pad assembly according to another embodiment of the present invention.

In one exemplary embodiment, the protrusions 103 are arranged in pyramidal tiers, with a greater number of protrusions of a comparatively larger size being located proximate to a base of the first panel 101 to provide, e.g., stability to the panel 101. For example, a plurality of adjacent pyramids 104 of protrusions 103 are provided on an interior surface of the first panel 101, as shown in FIGS. 1 and 2. Each pyramid 104 comprises a plurality of rows of protrusions 103 arranged in a pyramidal configuration. In addition, in one embodiment, the protrusions 103 decrease in size/diameter from a bottom row to a top row.

Advantageously, such configuration comprising, e.g., larger protrusions 103 at the base of the first panel 101 ascending to comparatively smaller protrusions 103 towards the top of the first panel 101 provides improved traction, upward lift and blood stimulation when the panel 101 is caused to be contacted with a wearer's breast. Furthermore, the pyramidal design of the protrusions 103 enables any weight that is placed upon it to be distributed inward and then upward, resulting in maximum lift of the breast. The larger protrusions 103 at the base provide extra lift and comfort at the base of the bra pad area, which bears a greater proportion of weight relative to the top of the pad. Preferably, the side pyramid formations are slightly tilted inwards to provide inward and upward support on the sides.

During wear and user movement, contact with the protrusions 103 generates movement within the bra cup, wherein the protrusions 103 are caused to be compressed and then subsequently released repeatedly, consequently, creating a natural-looking bounce and lift effect (e.g., during release of pressure from the protrusions 103). The orientation and configuration of the protrusions 103 advantageously maximizes their rebound effect off one other and increases lift of the breast. During 'compression', (e.g., when the protrusions/bubbles 103 are compressed together from pressure exerted on them due to weight being placed on the panel 101 during wearing of the bra assembly 100) the protrusions 103 contract together, thus providing increased support on the sides of the panel 101. The protrusions 103 are enabled to constantly shift, conform and mold to the shape of the wearer's breast due to their attachment to the pliable panel 101, which is configured to expand, contract and flex in response to movement, thus promoting a natural appearance.

The pad assembly 100 includes a second panel 107 partially attached to the first panel 101 along at least a bottom edge 119 thereof, which is preferably contiguous to both first and second panels 101, 107. Means for attachment of the first panel 101 and second panel 107 may comprise permanent means such as, e.g., adhesives, fusing, sealing, stitching, etc., and/or removable means such as eye-hooks, snaps, hook and loop fasteners (e.g., Velcro™), slidable 'zip-lock' type fasteners, etc.

While the first and second panels 101, 107 may comprise any shape, preferably the first and second panels are configured to have a substantially similar shape or outline to each other. Shapes which are sized and suited for conforming to and/or enhancing the human breast are preferred. In one exemplary embodiment, each of the first and second panels 101, 107 may be "scallop-shaped" or "tiara-shaped," i.e., each having a scalloped top edge having a plurality of (e.g., at least three) curves. Advantageously, the 'tiara' shape in essence acts like a 'tripod' wherein the right and left sides bend inwards towards the center for maximum lift.

Regardless of the shape(s) of the first and second panels 101, 107, the second panel 107 is preferably larger in size than the first panel 101 and preferably configured to at least overlap the first panel and in an especially preferred embodiment, e.g., to extend beyond the perimeter of the first panel 101 at least at the top and sides of the first panel 101, as shown e.g., in FIGS. 1 and 2.

In one exemplary embodiment, the second panel 107 is comprised of a liquid or semi-solid (e.g., gel) filled membrane. Dimensions of the second panel 107 may comprise, e.g., about 4 inches to about 5 inches in width and about 4 inches to about 5 inches in height. Preferred dimensions according to one exemplary embodiment comprise about 5 inches in width and about 4 inches in height.

Figure 4:
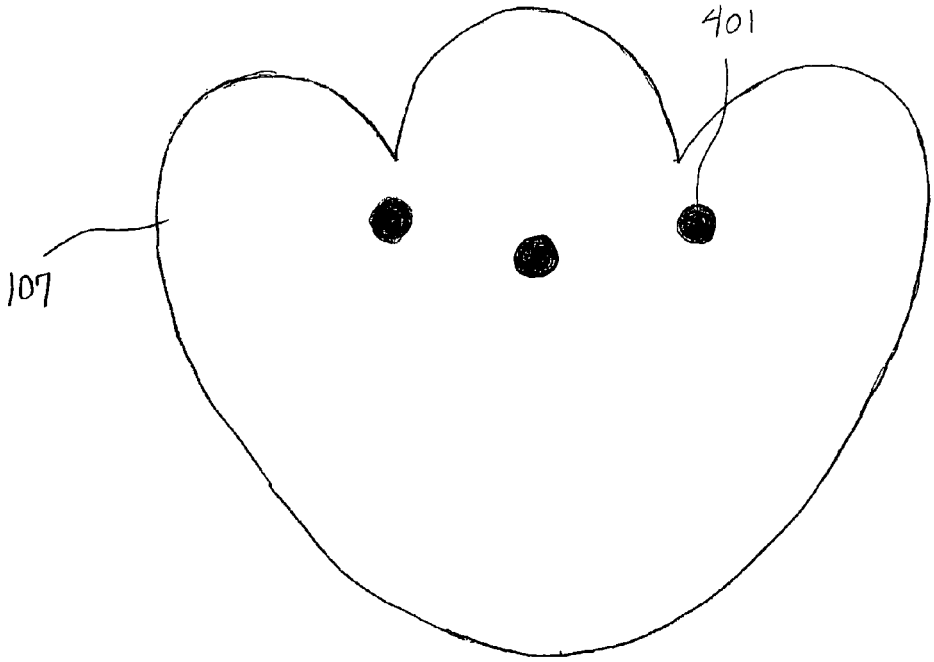
FIG. 4 is a front view of an exemplary external pad element according to an aspect of the present invention.
Figure 5:
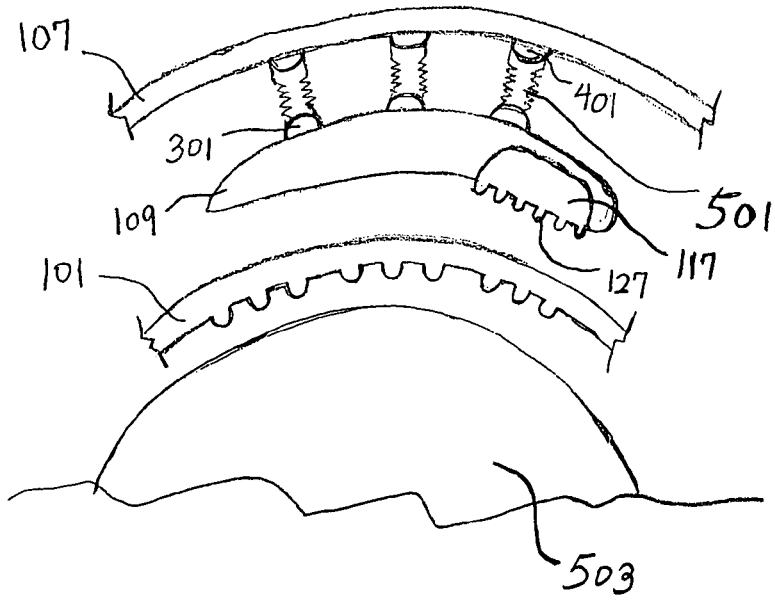
FIG. 5 is an exemplary top exploded view of a brassiere pad assembly configured for placement on a human breast according to an aspect of the present invention.
Figure 6:
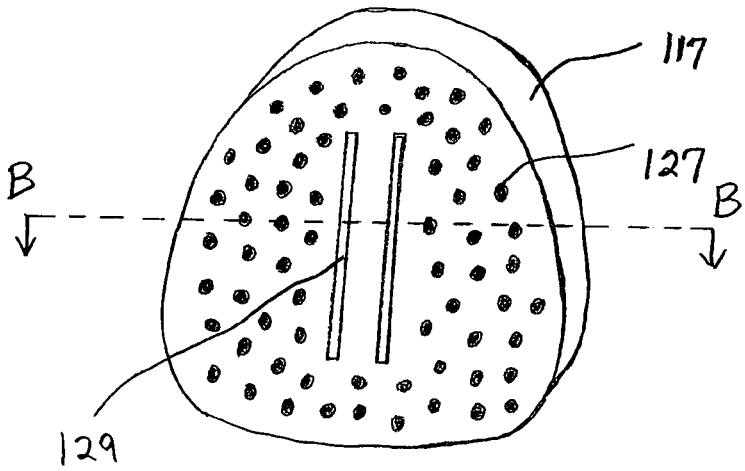
FIG. 6 is an exemplary front perspective view of a tablet configured for insertion into a brassiere pad assembly according to an aspect of the present invention.
Figure 7:
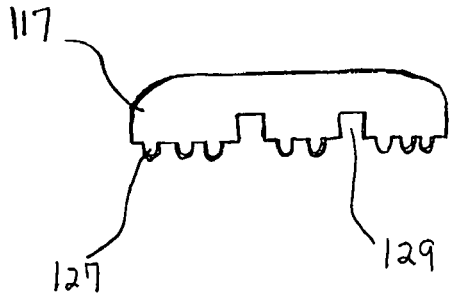
FIG. 7 is a top cross-sectional view of the insert element of FIG. 6 taken along line B-B according to an aspect of the present invention.

As depicted e.g., in FIGS. 4 and 5, the second panel 107 includes at least one, preferably a plurality of magnets 401 attached on an interior surface (facing the wearer) thereon. For example, a set of at least three magnets 401 may be provided, arranged to be substantially equidistant from each other and disposed along an arcuate line. Magnets 401 may also be disposed in a "tiara" or "tripod" orientation.

In accordance with one aspect of the present invention, a plurality of repelling magnets may be utilized. The magnets employed in accordance with the present invention may comprise any type of magnet, preferably magnets useful with respect to, e.g., magnetic therapy. Magnet therapy is used to treat a wide variety of diseases and conditions, from arthritis to poor circulation. The magnets may be made from, e.g., metallic elements, alloys, composites etc. and comprise magnets of different strengths. As is known, magnets of opposite poles attract because the magnetic field lines leave the north pole of one magnet and naturally enter the south pole of another, essentially creating one larger magnet. Magnets with like poles repel each other because their lines of force are traveling in opposite directions and thus clash with one another.

Each magnet used in a bra pad assembly according to the present invention may be comprised of any shape, size and may be attached thereon e.g., via adhesives, stitching, frictional fit, etc. or any combination of attachment methods. For example, in one embodiment, each magnet may be circular in shape and preferably at least a minimum of about one half of an inch in diameter and may be insertably retained within correspondingly shaped and sized magnet holders (not shown) configured to cover and secure the perimeter of each magnet for securing same. For example, the magnets may be fused/sealed within plastic covers which are secured to the appropriate parts of the bra pad assembly.

A third panel 109 may be provided, placed between the first and second panels 101, 107 and preferably attached to the second panel 107 at least along a bottom edge 121 (e.g., along the curved dotted line 121 shown in FIG. 1). The third panel 109 may be comprised of a solid, non-toxic liquid or semi-solid (gel) filled membrane, the membrane being comprised of a transparent, opaque or semi-opaque impermeable material such as e.g., plastic, rubber, or other liquid-impervious material. The material of the third panel 109 may be fused along a portion of its perimeter, to define a cavity preferably adapted to receive and retain objects therein. While the third panel 109 may comprise any shape or configuration, preferably at least a bottom edge 121 thereof is substantially curved. In one exemplary embodiment, the third panel 109 may comprise a curved U-shaped element (as shown in FIG. 1) or may comprise any shape or form, such as that, e.g., of a mermaid (as shown in FIG. 2).

Figure 3:
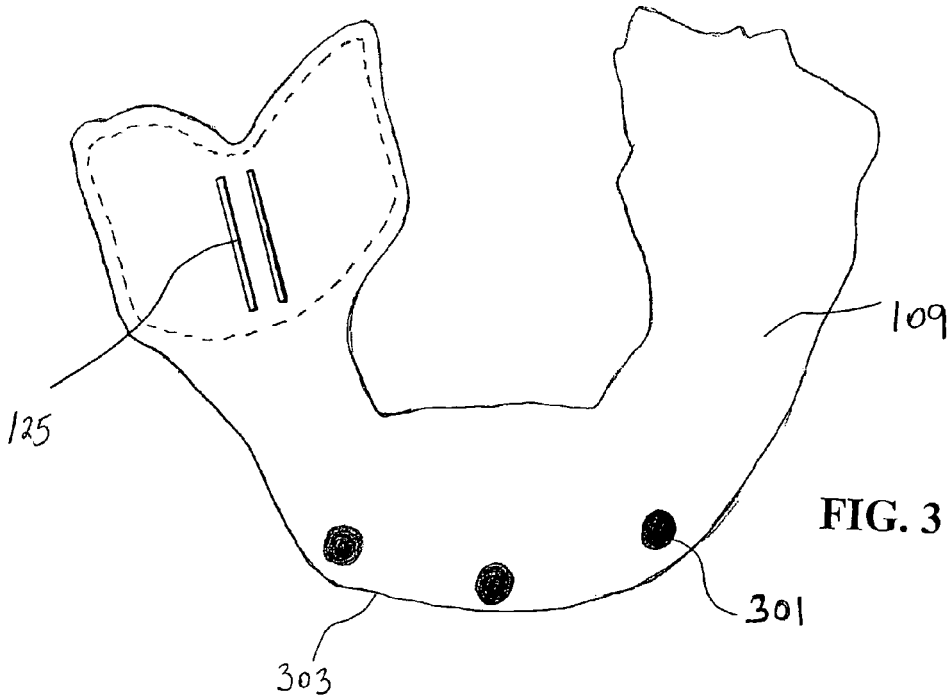
FIG. 3 is a rear view of an exemplary pad insert according to an aspect of the present invention.

Advantageously, the substantially semi-circular design, shape and configuration of the third panel 109 and its strategic placement between first and second panels 101, 107 preferably attached at a top half of the panel 107 (e.g., as shown in FIGS. 1-3) enables and optimizes the dispersal of therapeutic skin ingredients inserted within the third panel 109 (e.g., fatty acids, salts, oils, minerals and vitamins, etc.) as well as facilitates use of therapeutic and appearance-enhancing magnets as described in more detail hereinafter.

As shown e.g., in FIGS. 3 and 5, an exterior surface (facing away from the wearer's breast 503) of the third panel 109 preferably includes at least one, preferably a plurality of magnets 301 attached thereon. For example, a set of three magnets 301 may be provided, arranged to be substantially equidistant from each other and disposed along an arcuate line 303 (e.g., in a 'tripod' arrangement) and preferably in alignment with magnets 401 of the second panel 107 when the third panel 109 is secured between the first and second panels 101, 107.

Advantageously, a triangular or 'tripod' arrangement of the magnets 301, 401 (e.g., angled inwards to hug the breast 503 during wearing of the bra pad) enhances structural support and provides maximum lift and bounce.

Each of the magnets 401 of the second panel 107 is preferably configured and arranged to repel each of the magnets 301 of the third panel 109 (e.g., the magnets 401 are of like magnetic poles to those of the magnets 301). Each magnet 401 is preferably aligned with each corresponding magnet 301 of the third panel 109 via at least one flexible connector means 501, which may comprise, e.g., a tubular member of elasticized, flexible and/or pleated material (e.g., textile, rubber, latex, plastic, etc.) configured to be expandable/contractable along its longitudinal axis yet have sufficient rigidity so as to substantially align the connected magnets 301, 401 (either in individual pairs—a single one of magnets 301 to a corresponding single magnet 401, or in any combination—e.g., a plurality of magnets 301 to a plurality of magnets 401). The connector 501 permits axial movement of aligned opposing magnets (i.e., the aligned magnets may move towards and away from each other in a substantially direct path), while minimizing lateral movement (i.e., maintaining substantial alignment).

For example, the connector 501 may have a first end secured around one of magnets 301 and a second end secured around a corresponding magnet 401 so as to substantially align and connect the two. The connector 501 may be configured in an 'accordion' or bellows style, so as to physically accommodate effective expansion/contraction of same along its longitudinal axis. The flexible connector 501 advantageously flexibly maintains substantial alignment of the opposing magnets 301, 401 thus maintaining the repelling magnetic forces between them, while simultaneously permitting axial movement of the aligned magnets (towards and away from each other). This allows for maximum mobility and bounce off repelling forces of magnets with like poles.

For example, one magnet could be located at one end of the accordion/bellow-style conductor 501 which forces the opposing magnet in the opposite direction. Again, the magnets are preferably positioned in a tripod design for structural support and are slightly slanted inwards on each of the right and left sides towards the center for maximum lift upwards.

The repelling force of the aligned magnets 301, 401 having like poles assists in overcoming the force of gravity, thus providing optimal support and lift of the wearer's breasts as well as continuous natural-looking movement and bounce. According to one exemplary embodiment, the curved configuration and alignment of a plurality of magnets within the pad assembly 100 advantageously creates an "anti-gravity" effect that provides extreme lift, bounce, support and aesthetic appeal.

In stark contrast to conventional brassiere cups/pads that often sag or sink downwards when the weight of a breast is supported therein, any weight placed within a brassiere pad assembly according to an aspect of the present invention will be lifted and supported due to the configuration, orientation and repellant properties of the magnets 301, 401 in conjunction with the structural design of the first, second and third panels 101, 107, 109, respectively. A pad assembly 100 according to an aspect of the present invention supports the weight exerted by the breast within each cup without sagging or drooping, while maintaining a natural appearance and enhanced movement. The result is a brassiere pad that provides superior support, lift and comfort, as well as aesthetic appeal and health benefits.

Figure 10:
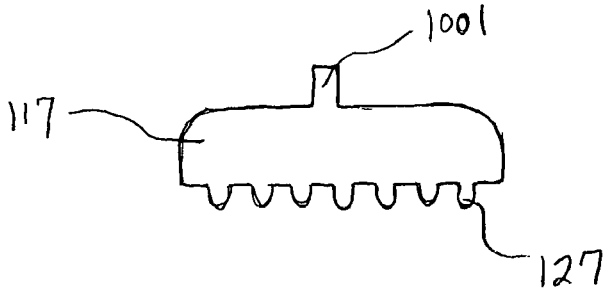
FIG. 10 is a top cross-sectional view of an insert element according to an alternate embodiment of the present invention.
Figure 11:
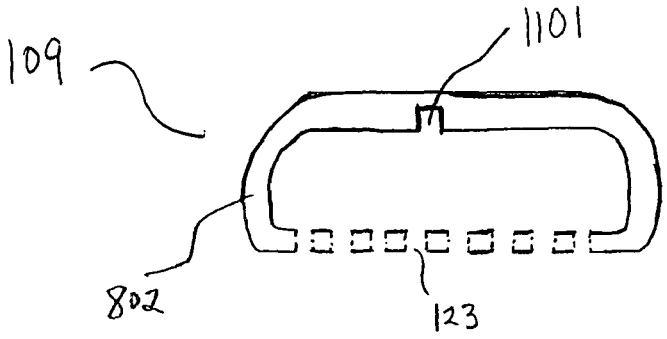
FIG. 11 is a top cross-sectional view of a receiving area of an insert element according to an alternate embodiment of the present invention.
Figure 12:
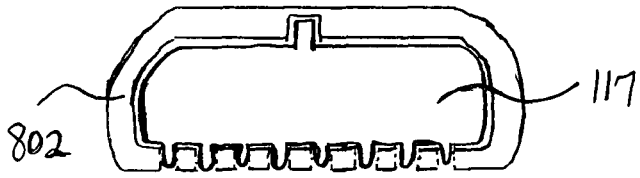
FIG. 12 is a top cross-sectional view of an insert element affixed within a third panel according to an alternate embodiment of the present invention.

Referring now to FIGS. 7-12, FIGS. 7-9 depict a third panel 109 and insertable element 117 according to one exemplary embodiment in which the element 117 includes recesses and the panel 109 includes protrusions for enabling coupling there between. FIGS. 10-12 depict a third panel 109 and insertable element 117 according to an alternate embodiment, in which the element 117 includes at least one protrusion and the panel 109 includes at least one recess.

Figure 8:
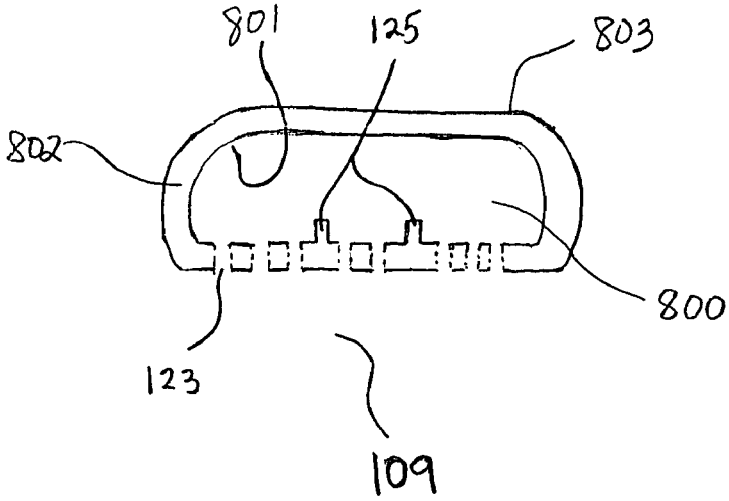
FIG. 8 is a top cross-sectional view taken along lines A-A in FIG. 1.
Figure 9:
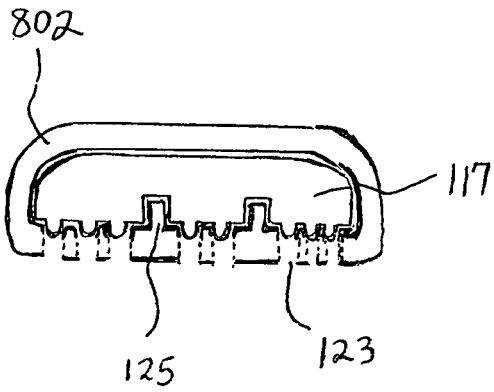
FIG. 9 is an exemplary top cross-sectional view of an insert element affixed within a third panel according to an aspect of the present invention.

The third panel 109 may comprise, e.g., a membrane 802 defining a cavity 800 and having at least one attachment means 125, 1101 formed thereon, either on the front or back of the third panel 109 (e.g., as shown in FIGS. 8 and 11). The attachment means 125, 1101 may comprise, e.g., a track or rail system (e.g., one or more protruding tracks), indentations, recesses, detents, grooves, or other attachment means which facilitate, e.g., secure slidable and/or frictional coupling (e.g., an L-shaped or C-shaped member, etc.) with an object to be inserted within the cavity 800.

The third panel 109 further includes a plurality of apertures 123 distributed on at least one side of the membrane 802, although the entire third panel 109 may include apertures 123 or voids distributed throughout. Exemplary dimensions of the apertures 123 may comprise, e.g., about 3.0 mm to about 10.0 mm in width/diameter.

An insertable element 117 may be provided preferably configured to be receivable within the cavity 800 of the third panel 109. The insertable element 117 may comprise, e.g., a solid material or tablet comprised of and/or infused with therapeutic/beneficial skin ingredients, such as salts, minerals, vitamins, fatty acids, lipids, oils, waxes, amino acids, proteins, herbal, botanical and/or seaweed extracts, etc. The tablet 117 may be composed, e.g., in an effervescent and/or dissolvable formulation and be made to be disposable as it disintegrates. The tablet 117 may include a plurality of protrusions 127 on at least one side thereof configured to be at least partially receivable within and/or exposed via the apertures 123. That is, the tablet 117 may include raised areas 127 which are configured to protrude through the apertures 123 of the third panel 109 to allow contact of at least the raised areas 127 of the tablet 117 with the skin during use. The tablet 117 may further include perforations (e.g., in a 'honeycomb' pattern) distributed throughout which may replace some of the protrusions 123 to promote air circulation.

Preferably, the element 117 includes attachment means 129, 1001 affixed and/or integrally formed thereon for enabling removable slidable and/or frictional coupling of the element 117 within the third panel 109. The attachment means 129, 1001 may comprise any elements configured for coupling/mating with the corresponding attachment means 125, 1101 of the third panel 109, e.g., counterpart recesses, detents, rail or track members, etc.

For example, the attachment means 125 may comprise a pair of parallel rails, wherein the center of the rails may have an indentation or any recessed shape which is configured to correspond to a counterpart raised/embossed design on an insertable element/tablet 117. When the tablet 117 is inserted into pad 109, it would be essentially fixed into position therein. For example, the pad 109 may include a magnetic strip along its perimeter, as one way of enclosing the tablet 117. It is to be understood that various alternate means for effectuating the desired attachment of a tablet 117 within the pad 109 may be contemplated.

The pad 109 may be configured to accept one or more tablets 117, e.g., at any location thereon, the tablets being of any suitable size or desired shape.

Advantageously, the tablet 117 is configured and arranged to be in direct contact with the skin while being removable when desired (e.g., when the undergarment/bra pad assembly is desired to be laundered). The tablet 117 may accordingly be replaced when necessary with new tablets. The benefits of a disposable tablet 117 in the brassiere system include: 1) direct contact with the skin—ingredients are more concentrated, 2) longer life of the tablet, as it can be removed before washing the undergarment/bra pad, and 3) the tablet ingredients make direct contact with the skin and work together with, e.g., the silicone (described further below) to have the most beneficial effect for their dispersal and continued absorption through body heat.

Advantageously, a bra pad assembly according to an aspect of the present invention provides application and distribution of therapeutic ingredients onto the skin of the wearer, wherein the ingredients of the insertable element will be enabled to be dispersed onto and be absorbed by the skin via the apertures 123. Further, in conjunction with the therapeutic skin effects, the positioning of the magnets, e.g., in a "tiara" formation, (e.g., a plurality of magnets disposed along an arcuate line), enables the magnets to force the bra pad inwards and upwards, pulling the insertable element 117 and third panel 109 upwards, therefore, forcing distribution of topical skin ingredients from the insert element 117 throughout the pad area of the first panel 101.

The positioning of the magnets according to an aspect of the present invention (e.g., disposed along a curved line) provides structural support as well as maximum bounce, upwards lift and distribution of topical skin products. The connection 501 between the magnets of panel 107 and panel 109 maintains constant repellant force between the aligned magnets while concurrently providing mobility so as to enable movement of the magnets in horizontal and vertical planes, e.g., the magnets can sway up and down and from side to side. Such movement further causes movement of the third panel 109, thus facilitating dispersal of the ingredients (e.g., vitamins, minerals, salts, etc.) of insert element/tablet 117 throughout the first panel 101 and the skin, allowing the ingredients to be dispersed through direct and varied contact with the skin during wear.

In a preferred embodiment, the first panel 101 is preferably comprised of a flexible insulator material, e.g., silicone, neoprene, etc. having a plurality of apertures (e.g., in a 'filigree' design). For example, during use, the insulator material (e.g., silicone) is heated by and retains natural heat from the wearer's body, thus allowing for maximum storage of body heat. The thermal insulator properties of the silicone together with its flexibility and breathable properties due to its perforated or 'filigree' pattern allows it to mold to the skin, maintaining maximum surface area contact with the skin and promoting absorption of the skin ingredients (salts, minerals, etc.) of the tablet 117 by the wearer's skin. The flexibility and molding of the insulator material to the skin allows for maximum support as well.

Namely, the insulator material absorbs and maintains the heat of the body, thus activating the salts, minerals, etc. that are being diffused from tablet 117 through panel 109 and allows for maximum absorption through contact with the skin. Dispersal of the skin ingredients is further encouraged throughout the entire surface area of the perforated insulator material via body heat.

In addition, movement facilitated by a magnet configuration according to an aspect of the present invention compounded by the filigree/perforated design of the pad 101 further encourages dispersal of the skin ingredients throughout the surface area of the insulator pad 101 and direct and varied contact over a maximized surface area of the skin. In an embodiment where, e.g., silicone is utilized, such material further provides additional traction and lift, in addition to flexibility and optimal absorption of the topical skin ingredients dispensed from element 117.

To reiterate, one exemplary embodiment of the invention (in particular, an embodiment wherein silicone is employed,) may be described as follows: "Silicone Tiara"—part 101 of the brassiere pad assembly is positioned in front of the three-part design of the assembly and resembles the shape of a tiara and further has a crochet-like pattern. Part 101 may be comprised of silicone for elasticity and dispersing properties, as explained above, and its crochet-like pattern allows for breathability, and flexibility (molding to the shape of the human body for superior comfort and support), allows the silicone to adhere to the skin better and allows for optimal retention of body heat, thus allowing vitamins, minerals, etc. in the tablet 117 to be dispersed. The tiara tripod design adds structural support, and its sides (i.e., lower side points of tiara) are also preferably slightly slanted for maximum bounce and lifting of each breast upwards. Part 101 has direct contact with the skin when the three-part design of the brassiere pad is worn, thus optimizing contact with the skin and distribution and application of therapeutic ingredients (e.g., vitamins, minerals, etc.) as, for example, explained above. In one example, part 101 may measure approximately 4 inches in width and 3.5 inches from top to bottom. Part 101 is attached to Part 107 at least along bottom of the brassiere pad as shown, e.g., in FIG. 1.

Benefit of Silicone in Part 101: The "Silicone Tiara" of the brassiere pad acts as a "dispersing" element for the therapeutic skin ingredients contained in the tablet 117 inserted in Part 109, which includes a plurality of apertures. Namely, the silicone is heated by natural heat from the body and acts as a heating pad. The thermal insulation properties of the silicone together with the breathability properties due to its filigree configuration in a crochet-like design will allow the tablet's ingredients to be distributed onto and absorbed through the skin. Silicone absorbs and helps maintain body heat, thus diffusing and activating the ingredients from tablet 117 through part 109 and allowing for maximum skin absorption of same when contacted with the skin.

The substances (therapeutic skin ingredients, vitamins, minerals, salts, etc.) in tablet 117 make direct contact with the skin through the open areas/apertures in part 109. The vitamins/minerals/salts are infused throughout the surface of the silicone via body heat and dispersed throughout the entire surface area of the "silicone tiara" (part 101). The silicone is heated through contact with skin and body heat emitted from skin; salts in tablet 117 make contact with the skin through open areas in part 109; salts are heated and activated by body heat; vitamins and minerals infused in salts contained in tablet 117, are dispersed throughout surface area of silicone via body heat; in addition, movement of the assembly facilitated by the configuration and arrangement of magnets 301, 401 further assists in dispersing vitamins/minerals/salts, etc. throughout the silicone surface area and tiara pad; the 'filigree' design allows more contact with skin which results in greater absorption of body heat and subsequently, greater distribution of the vitamins/minerals/salts, etc. The silicone material having a 'filigree' configuration will allow for traction, lift, flexibility, breathability and absorption of sea minerals through the skin.

An additional important benefit of a brassiere system according to the present invention is its ability to alleviate pressure on the shoulder area, which is a major problem for women who wear larger cup sizes. Indeed, many of these women often seek surgical breast reduction as a last resort solution to alleviate fatigue and postural problems caused by inadequate breast support as well as pain and pressure in their shoulder and upper torso caused by the weight placed upon them by bra straps.

Although the embodiment which incorporates the teachings of the present invention has been shown and described in detail herein, those skilled in the art can readily devise many other varied embodiments that still incorporate these teachings. Having described preferred embodiments for a bra pad assembly (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A brassiere pad assembly comprising:

a first brassiere pad panel having a bottom edge;

a second brassiere pad panel having an interior surface and an exterior surface, the second panel having at least a bottom edge affixed to at least the bottom edge of the first panel; and a third brassiere pad panel comprising a membrane defining a cavity having at least one attachment means formed therein, the third brassiere pad panel being placed between the first and second brassiere pad panels and having at least a bottom edge affixed to the second brassiere pad panel, wherein a plurality of magnets are attached to the interior surface of the second brassiere pad panel.

2. The assembly of claim 1, further comprising a plurality of magnets attached to an exterior surface of the third brassiere pad panel, wherein each of the magnets attached on the third brassiere pad panel is configured to be in substantial alignment with and repel each corresponding magnet of the second brassiere pad panel.

3. The assembly of claim 2, further comprising at least one flexible connector having a first end attached to at least one of the magnets of the second brassiere pad panel, and a second end attached to at least one corresponding magnet of the third brassiere pad panel, the connector for keeping each of the magnets of the second brassiere pad panel in substantial alignment with each of the magnets of the third brassiere pad panel while permitting axial movement of the aligned magnets.

4. The assembly of claim 3, wherein the connector is comprised of a tubular member configured to be expandable and contract-able.

5. The assembly of claim 1, wherein the first brassiere pad panel is comprised of a flexible insulation material having a plurality of perforations, the first brassiere pad panel further comprising a plurality of protrusions affixed on an interior surface thereon.

6. The assembly of claim 5, wherein the plurality of protrusions comprise larger protrusions disposed proximate to a base of the first panel ascending to comparatively smaller protrusions disposed towards a top of the first panel.

7. The assembly of claim 5, wherein the protrusions comprise at least one fluid, semi-solid or air-filled vesicles.

8. The assembly of claim 1, wherein the membrane of the third brassiere pad panel includes a plurality of apertures.

9. The assembly of claim 1, further comprising an insertable element affixed within the cavity and secured therein via the cavity attachment means.

10. The assembly of claim 9, wherein the insertable element comprises a tablet infused with skin therapeutic ingredients, the tablet including attachment means configured for mating with the cavity attachment means.

11. A brassiere pad assembly for a brassiere comprising:

a first brassiere pad panel having a bottom edge;

a second brassiere pad panel having an interior surface and an exterior surface, the second brassiere pad panel having at least a bottom edge affixed to at least the bottom edge of the first brassiere pad panel and a plurality of magnets attached to the interior surface of the second brassiere pad panel; and a third brassiere pad panel comprising a membrane defining a cavity having at least one attachment means formed therein, the third brassiere pad panel being placed between the first and second brassiere pad panels and having at least a bottom edge affixed to the second brassiere pad panel.

12. The assembly of claim 11, further comprising a plurality of magnets attached to an exterior surface of the brassiere pad third panel, wherein each of the magnets attached on the third brassiere pad panel is configured to be in substantial alignment with and repel each corresponding magnet of the second brassiere pad panel.

13. The assembly of claim 12, further comprising at least one flexible connector having a first end attached to at least one of the magnets of the second brassiere pad panel, and a second end attached to at least one corresponding magnet of the third brassiere pad panel, the connector for keeping each of the magnets of the second brassiere pad panel in substantial alignment with each of the magnets of the third brassiere pad panel while permitting axial movement of the aligned magnets.

14. The assembly of claim 13, wherein the connector is comprised of a tubular member configured to be expandable and contract-able.

15. The assembly of claim 11, wherein the first brassiere pad panel is comprised of a flexible insulation material having a plurality of perforations, the first brassiere pad panel further comprising a plurality of protrusions affixed on an interior surface thereon.

16. The assembly of claim 15, wherein the plurality of protrusions comprise larger protrusions disposed proximate to a base of the first brassiere pad panel ascending to comparatively smaller protrusions disposed towards a top of the first brassiere pad panel.

17. The assembly of claim 15, wherein the protrusions comprise at least one fluid, semi-solid or air-filled vesicles.

18. The assembly of claim 11, wherein the membrane of the third brassiere pad panel includes a plurality of apertures.

19. The assembly of claim 11, further comprising an insertable element configured to be receivable within said cavity and affixable therein via the cavity attachment means.

20. The assembly of claim 19, wherein the insertable element comprises a tablet infused with skin therapeutic ingredients, the tablet including attachment means configured for mating with the cavity attachment means.

21. A brassiere pad assembly for a brassiere comprising:

a first magnetic brassiere pad panel having an interior surface and an exterior surface, the panel having a plurality of magnets attached to the interior surface thereof; and a second magnetic brassiere pad panel affixed to the first magnetic brassiere pad panel and further comprising a plurality of magnets attached to an exterior surface of the second magnetic brassiere pad panel, wherein each of the magnets on the second magnetic brassiere pad panel is configured to face and be in substantial alignment with and repel each corresponding magnet of the first magnetic brassiere pad panel.

22. The assembly of claim 21, wherein the second magnetic brassiere pad panel comprises a membrane defining a cavity.

23. The assembly of claim 21, further comprising at least one flexible connector having a first end attached to at least one of the magnets of the first magnetic brassiere pad panel, and a second end attached to at least one corresponding magnet of the second magnetic brassiere pad panel, the connector for keeping each of the repelling magnets of the first and second magnetic brassiere pad panels in substantial alignment with each other while permitting axial movement of the aligned magnets.

24. The assembly of claim 23, wherein the connector is comprised of a tubular member configured to be expandable and contract-able.

25. A brassiere pad assembly for a brassiere comprising:

a first brassiere pad panel having at least one magnet attached thereon; and a second brassiere pad panel adjacent to the first brassiere pad panel and further comprising at least one magnet attached to the second brassiere pad panel, wherein said at least one magnet on the second brassiere pad panel is configured to repel the at least one magnet of the first brassiere pad panel.

* * * * *